US008401438B2

(12) United States Patent
Ichikawa et al.

(10) Patent No.: US 8,401,438 B2
(45) Date of Patent: Mar. 19, 2013

(54) CONVEYANCE MEMBER, DEVELOPER CARTRIDGE, AND IMAGE-FORMING APPARATUS

(75) Inventors: Hideo Ichikawa, Ebina (JP); Ryoji Sugimoto, Minamiashigara (JP); Takashi Sakamoto, Ebina (JP); Masatoshi Norigoe, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 475 days.

(21) Appl. No.: 12/711,868

(22) Filed: Feb. 24, 2010

(65) Prior Publication Data

US 2011/0002714 A1 Jan. 6, 2011

(30) Foreign Application Priority Data

Jul. 2, 2009 (JP) ..... 2009-157827

(51) Int. Cl.
*G03G 15/08* (2006.01)

(52) U.S. Cl. ..... 399/263

(58) Field of Classification Search ..... 399/263, 399/262, 260, 256

See application file for complete search history.

(56) References Cited

U.S. PATENT DOCUMENTS

| | | | | |
|---|---|---|---|---|
| 6,585,406 | B2 * | 7/2003 | Toepper et al. | 399/256 |
| 7,248,823 | B2 * | 7/2007 | Buhay-Kettelkamp et al. | 399/263 |
| 7,869,747 | B2 * | 1/2011 | Ichikawa | 399/263 |
| 7,925,189 | B2 * | 4/2011 | Norigoe | 399/256 |
| 2007/0077100 | A1 | 4/2007 | Suzuki et al. | |
| 2010/0034545 | A1 * | 2/2010 | Imamura | 399/256 |
| 2010/0111574 | A1 * | 5/2010 | Ichikawa | 399/263 |
| 2011/0013946 | A1 * | 1/2011 | Takeda et al. | 399/263 |
| 2011/0052269 | A1 * | 3/2011 | Kimura et al. | 399/263 |

FOREIGN PATENT DOCUMENTS

| | | | |
|---|---|---|---|
| JP | 10-247009 | A | 9/1998 |
| JP | 2000-305344 | A | 11/2000 |
| JP | 2002-268344 | A | 9/2002 |
| JP | 2005-221825 | A | 8/2005 |
| JP | 2006-030488 | A | 2/2006 |
| JP | 2006-053446 | A | 2/2006 |
| JP | 2006-267680 | A | 10/2006 |
| JP | 2008-241880 | A | 10/2008 |
| JP | 2010-113094 | A | 5/2010 |
| JP | 2010-113904 | A | 5/2010 |

OTHER PUBLICATIONS

Japanese Office Action dated Nov. 22, 2011 for corresponding Japanese patent application No. 2009-157827.

* cited by examiner

*Primary Examiner* — Susan Lee
(74) *Attorney, Agent, or Firm* — Sughrue Mion, PLLC

(57) ABSTRACT

A conveyance member includes: a rotational shaft; a support portion that extends from the rotational shaft in a direction crossing an axial direction of the rotational shaft; and an arcuate member that includes one end that is supported by the support portion, and another end that extends in a direction different from the rotational direction, wherein a distance between an outer edge of the arcuate member at the other end and the rotational shaft is longer than a distance between an outer edge of the arcuate member at the one end and the rotational shaft.

20 Claims, 8 Drawing Sheets

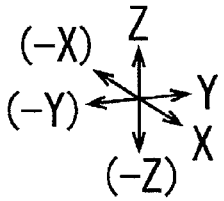
FIG. 1
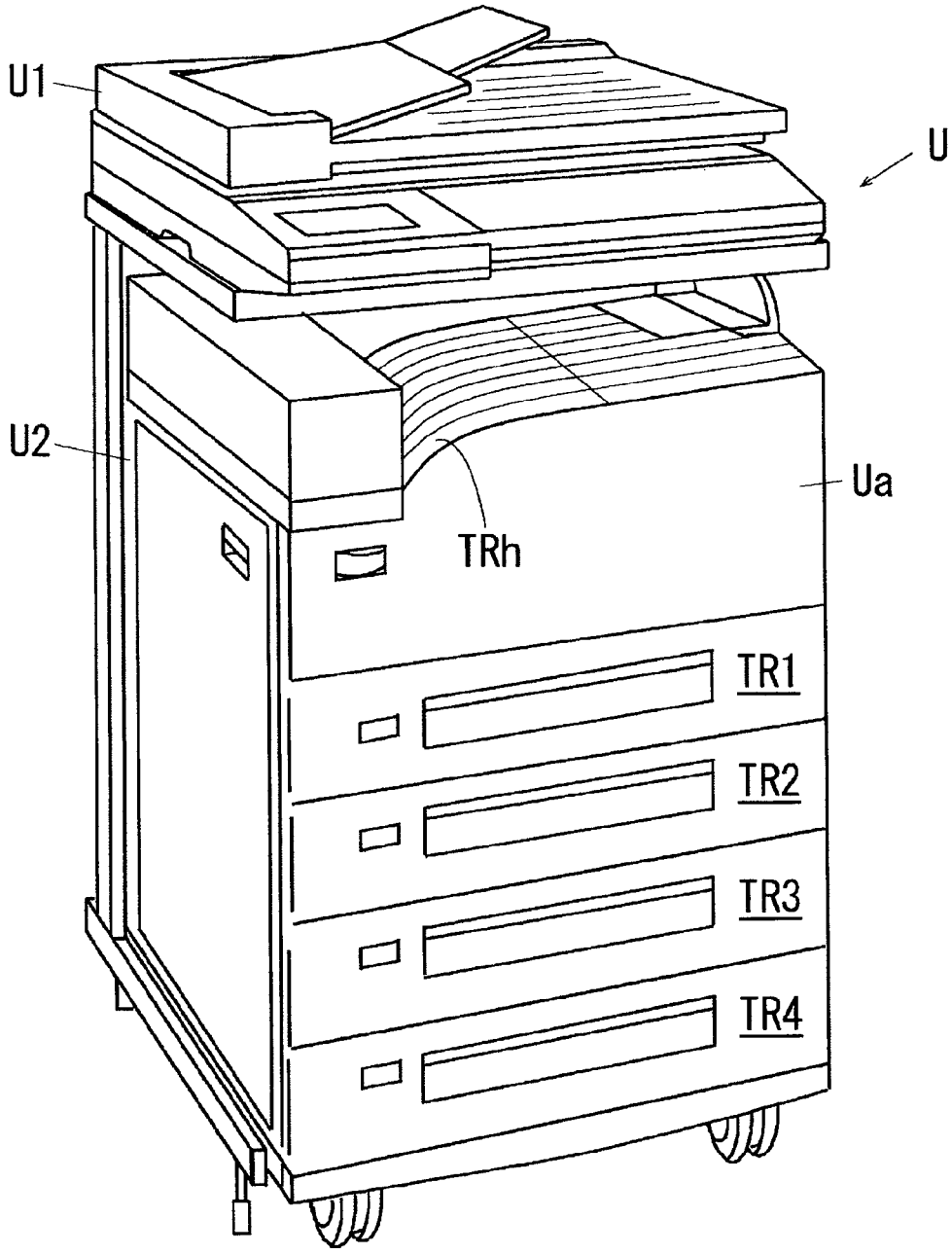

r1 < r2

CONVEYANCE MEMBER, DEVELOPER CARTRIDGE, AND IMAGE-FORMING APPARATUS

CROSS-REFERENCE TO RELATED APPLICATIONS

This application is based on and claims priority under 35 USC 119 from Japanese Patent Application No. 2009-157827 filed on Jul. 2, 2009.

BACKGROUND

1. Technical Field

The present invention relates to a conveyance member, a developer cartridge, and an image-forming apparatus.

2. Related Art

In an image-forming apparatus that develops a latent image using developers, a detachable developer cartridge is used as a disposable unit for supplying a developing device with developers.

SUMMARY

An aspect of the present invention provides a conveyance member including: a rotational shaft; a support portion that extends from the rotational shaft in a direction crossing an axial direction of the rotational shaft; and an arcuate member that includes one end that is supported by the support portion, and another end that extends in a direction different from the rotational direction, wherein a distance between an outer edge of the arcuate member at the other end and the rotational shaft is longer than a distance between an outer edge of the arcuate member at the one end and the rotational shaft.

BRIEF DESCRIPTION OF THE DRAWINGS

Exemplary embodiments of the present invention will now be described in detail with reference to the following figures, wherein:

FIG. 1 is an oblique perspective figure of an image-forming apparatus according to an exemplary embodiment of the present invention;

DETAILED DESCRIPTION

Figure 2:
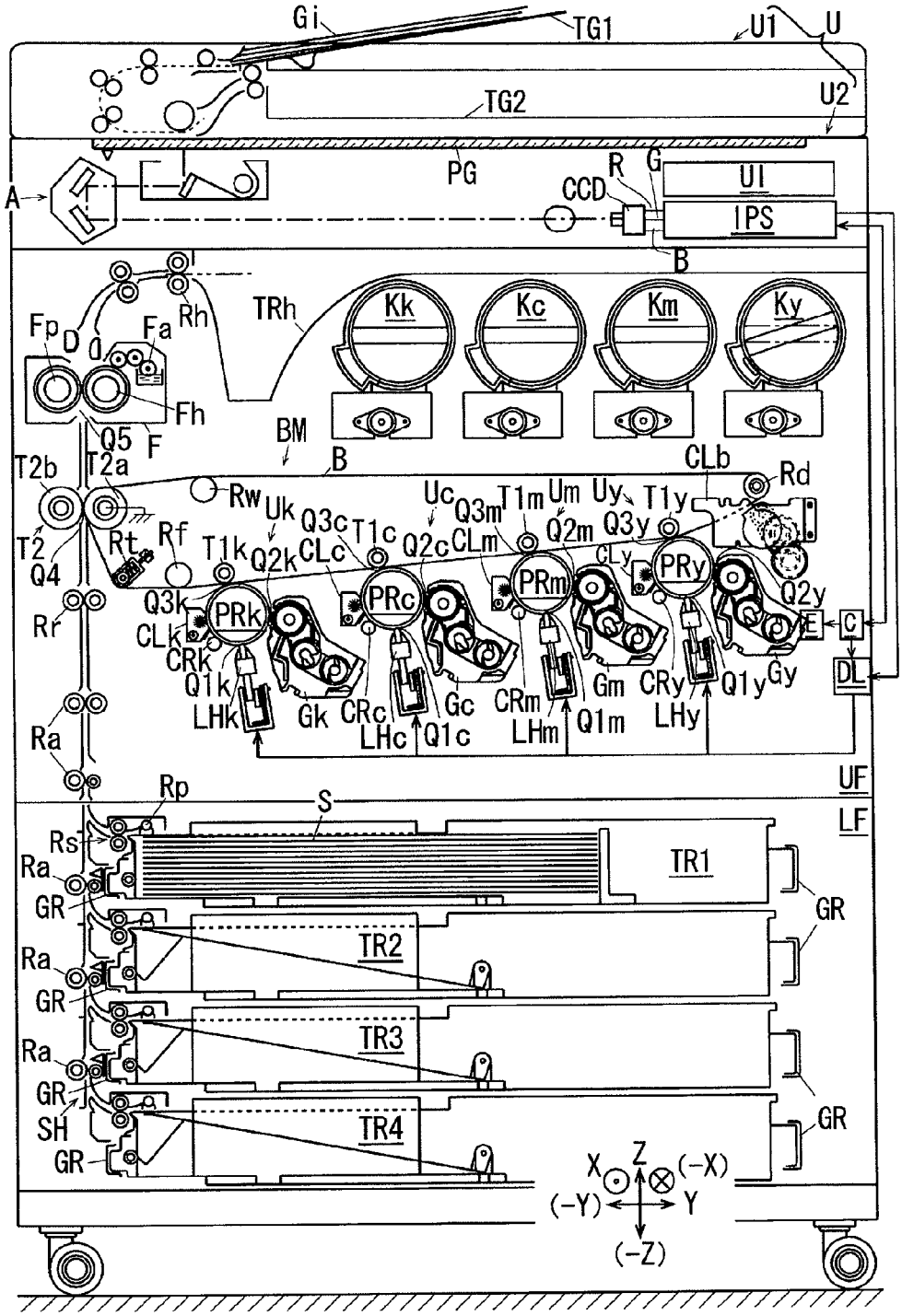
FIG. 2 is a diagram showing an internal configuration of an image-forming apparatus.

Exemplary embodiments of the present invention will now be described with reference to the drawings.

It is to be noted that in the drawings, a longitudinal direction as viewed from the front of an image-forming apparatus by a user is referred to as an x-axis direction, a horizontal direction is referred to as a y-axis direction, and a vertical direction is referred to as a z-axis direction. Accordingly, a direction indicated by arrow X, -X, Y, -Y, Z, or -Z will be referred to as "front," "back," "right," "left," "up," or "down," respectively. Also, a side indicated by arrow X, -X, Y, -Y, Z, or -Z will be referred to as "front side," "back side," "right side," "left side," "upper side," or "lower side," respectively. The front-back direction is a main scanning direction of an image-forming apparatus, the horizontal direction is a sub-scanning direction of an image-forming apparatus, and a downward direction is the direction of gravitational force. It is also to be noted that in the drawings, a dot appearing in a circle marked indicates an arrow pointing toward the front of a drawing from the back, and a cross in a circle indicates an arrow pointing from the front to the back face of a drawing.

[Overall Configuration of Entire Image-Forming Apparatus]

FIG. 1 is an oblique perspective figure of image-forming apparatus U according to the present exemplary embodiment.

In the drawing, image-forming apparatus U includes automatic document feeder U1 arranged at an upper side of the apparatus, and apparatus body U2 that supports automatic document feeder U1. At the upper side of apparatus body U2, a paper output unit TRh to which a sheet, which is an example of a medium, is outputted is provided. At the lower side of apparatus body U2, plural paper supply units TR1 to TR4 that store sheets are detachably provided. At the upper front side of apparatus body U2, front cover Ua, which is an example of a front opening and closing member, is provided.

FIG. 2 is a diagram showing an internal configuration of image-forming apparatus U.

Automatic document feeder U1 includes document feeding unit TG1 on which plural documents Gi, which are to be copied, are stacked, and document output unit TG2 to which document Gi, which is fed from document feeding unit TG1, and carried through a document reading position placed on transparent platen glass PG, is outputted. Automatic document feeder U1 also includes operation unit UI by use of which a user inputs an operation instruction such as a start of an image-forming operation, and exposure optical system A. If light is reflected by a document conveyed above platen glass PG of automatic document feeder U1, or a document manually placed on platen glass PG, the light passes through exposing optical system A, and is converted into electric signals representing red (R), green, (G), and blue (B) by solid-state image sensing device CCD. Image data conversion unit IPS converts RGB electric signals input from solid-state image sensing device CCD into image data of black (K), yellow (Y), magenta (M), and cyan (C), temporarily stores the data, and outputs it to latent-image-forming device driving circuit DL. It is to be noted that in a case where a document image is unicolor or black-and-white, image data of only black is input to latent-image-forming device driving circuit DL. Latent-image-forming device driving circuit DL includes a driving circuit (not shown) for each color of Y, M, C, and K, and outputs signals according to input image data to latent-image-forming devices LHy, LHm, LHc, and LHk that are respectively provided for Y, M, C, and K.

Visible-image-forming devices Uy, Um, Uc, and Uk arranged inside apparatus body U2 are devices for forming a visible image of a color of Y, M, C, or K. Visible-image-forming device Uy, Urn, Uc, or Uk irradiates latent-image-writing light of Y, M, C, or K from its latent-image-writing light source, and the light falls on rotating image carrier PRy, PRm, PRc, or PRk. Latent-image-forming devices LHy to LHk may include a LED array. Visible-image-forming device Uy, which corresponds to the color of yellow (Y), includes rotating image carrier PRy, charging device CRy, latent-image-forming device LHy, developing device Gy, transfer device T1*y*, and image carrier cleaning device CLy. Among these devices, image carrier PRy, charging device CRy, and image carrier cleaning device CLy are integrated as an image carrier unit that can be attached to or detached from apparatus body U2. Visible-image-forming devices Um, Uc, and Uk have a configuration similar to that of visible-image-forming device Uy.

Image carrier PRy, PRm, PRc, or PRk is charged by its corresponding charging device CRy, CRm, CRc, or CRk, and thereafter on a surface of the image carrier, an electrostatic latent image is formed using latent-image-writing light Ly, Lm, Lc, or Lk, at image writing position Q1*y*, Q1*m*, Q1*c*, or Q1*k*. The electrostatic latent image is developed at developing area Q2*y*, Q2*m*, Q2*c*, or Q2*k*, using developers stored in developing roll R0*y*, R0*m*, R0*c*, or R0*k*, which is an example of a developer cartridge, of developing device Gy, Gm, Gc, or Gk, so that a toner image, which is an example of a visible image, is formed. The toner image is conveyed to first transfer area Q3*y*, Q3*m*, Q3*c*, or Q3*k* that is in contact with intermediate transfer belt B, which is an example of an intermediate transfer body.

At first transfer area Q3*y*, Q3*m*, Q3*c*, or Q3*k*, first transfer device T1*y*, T1*m*, T1*c*, or T1*k*, which is disposed at the reverse side of intermediate transfer belt B, is subject to a first transfer voltage applied by power circuit E controlled by controller C. The first transfer voltage has a reverse polarity with a charging polarity of toner. The toner image formed on image carrier PRy, PRm, PRc, or PRk is transferred to intermediate transfer belt B by first transfer device T1*y*, T1*m*, T1*c*, or T1*k*. After the first transfer is completed, the surface of image carrier PRy, PRm, PRc, or PRk is cleaned by image carrier cleaning device CLy, CLm, CLc, or CLk so that residuals on the surface are removed. After the cleaning of the surface is completed, the surface of image carrier PRy, PRm, PRc, or PRk is again charged by charging device CRy, CRm, CRc, or CRk.

Above image carrier PRy, PRm, PRc, or PRk, belt module BM, which is able to move in a vertical direction and can be pulled out, is provided. Belt module BM is an example of an intermediate transfer device. Belt module BM includes intermediate transfer belt B which is described above, belt driving roll Rd which is an example of an intermediate transfer body driving member, tension roll Rt which is an example of an intermediate transfer body suspending member, walking roll Rw which is an example of a meandering prevention member, idler roll Rf which is an example of a driven member, backup roll T2*a* which is an example of a second transfer area opposed member, and first transfer devices T1*y*, T1*m*, T1*c*, and T1*k*, which are described above. Intermediate transfer belt B is supported by rolls Rd, Rt, Rw, Rf, and T2*a* so that the belt is able to rotate. The rolls may be referred to as belt support rolls Rd, Rt, Rw, Rf, and T2*a*, which is an example of an intermediate transfer body support member. At a position opposed to a surface of intermediate transfer belt B that is in contact with backup roll T2*a*, second transfer roll T2*b*, which is an example of a second transfer member, is provided. Rolls T2*a* and T2*b* constitute second transfer device T2. An area in which second transfer roll T2*b* and intermediate transfer belt B face each other is second transfer area Q4. Plain color or multicolored toner images, which have been stacked on intermediate transfer belt B by first transfer devices T1*y*, T1*m*, T1*c*, and T1*k* at first transfer areas Q3*y*, Q3*m*, Q3*c*, and Q3*k*, are conveyed to second transfer area Q4.

Under visible-image-forming devices Uy to Uk, four matched pairs of guide rails GR, which are examples of a guide member, are provided. Guide rails GR support paper feed unit TR1, TR2, TR3, or TR4 so that the unit can be inserted or withdrawn in a front-back direction of the image-forming apparatus U. Sheets S stored in paper feed unit TR1, TR2, TR3, or TR4 are taken out by pickup roll Rp, which is an example of a medium pickup member, and one of the sheets is separated by retard roll Rs, which is an example of a medium separating member. The separated sheet S is transported to register rolls Rr that are arranged in the upstream side in a sheet transport direction of second transfer area Q4, by plural feed rolls Ra, which are examples of a medium transport member, along sheet transport path SH, which is an example of a medium transport path. Register rolls Rr are examples of a registration member for a timing when reaching a transfer area. Sheet transport path SH, sheet transport rolls Ra, and register rolls Rr constitute a sheet transport device.

Register rolls Rr transport sheet S to second transfer area Q4 so that the sheet reaches the area at the same time that the toner image formed on intermediate transfer belt B reaches second transfer area Q4. When sheet S passes through second transfer area Q4, backup roll T2*a* is grounded, and second transfer roll T2*b* is subject to a second transfer voltage that is applied by power source E controlled by controller C. The second transfer voltage has a reverse polarity with a charging polarity of toner. After the voltage is applied to second transfer roll T2*b*, the toner image formed on intermediate transfer belt B is transferred onto sheet S by second transfer device T2. After the second transfer is completed, intermediate transfer belt B is cleaned by belt cleaner CLb, which is an example of an intermediate transfer body cleaner. As described in the foregoing, in image-forming apparatus U, a transfer device that transfers a toner image formed on image carriers PRy to PRk to sheet S is constituted by first transfer devices T1*y* to T1*k*, intermediate transfer belt B, and second transfer device T2. Sheet S, on which the toner image has been transferred, is transported to fixing area Q5 in which a fixing operation by heating roll Fh and pressure roll Fp of fixing device F is applied. Heating roll Fh is an example of a heat-fixing member, and pressure roll Fb is an example of a pressure-fixing member. When sheet S passes through fixing area Q5, the toner image is heated and fixed on sheet S. Sheet S, on which the toner image has been fixed, is outputted to paper output unit TRh, which is an example of a medium ejection unit, by discharge roll Rh, which is an example of a medium ejection member.

Above belt module BM, developer cartridge units Ky, Km, Kc, and Kk that store developers of yellow (Y), magenta (M), cyan (C), or black (K), and supply image-forming apparatus U with the developers, are provided. Developers stored in developer cartridge unit Ky, Km, Kc, or Kk are supplied to developing device Gy, Gm, Gc, or Gk through a developer supply path (not shown) as developers contained in the developing device are consumed. Developer may be two-component developer including magnetic carrier and toner with additives.

Image-forming apparatus U includes upper frame UF and lower frame LF. In upper frame UF, visible-image-forming devices Uy to Uk and other members arranged above visible-image-forming devices Uy to Uk, such as belt module BM, are supported. In lower frame LF, guide rails GR supporting paper supply units TR1 to TR4, and paper feed members that feed a sheet from paper feed unit TR1, TR2, TR3, or TR4, such as pickup rolls Rp, retard rolls Rs, and sheet feed rolls Ra, are supported.

Figure 3:
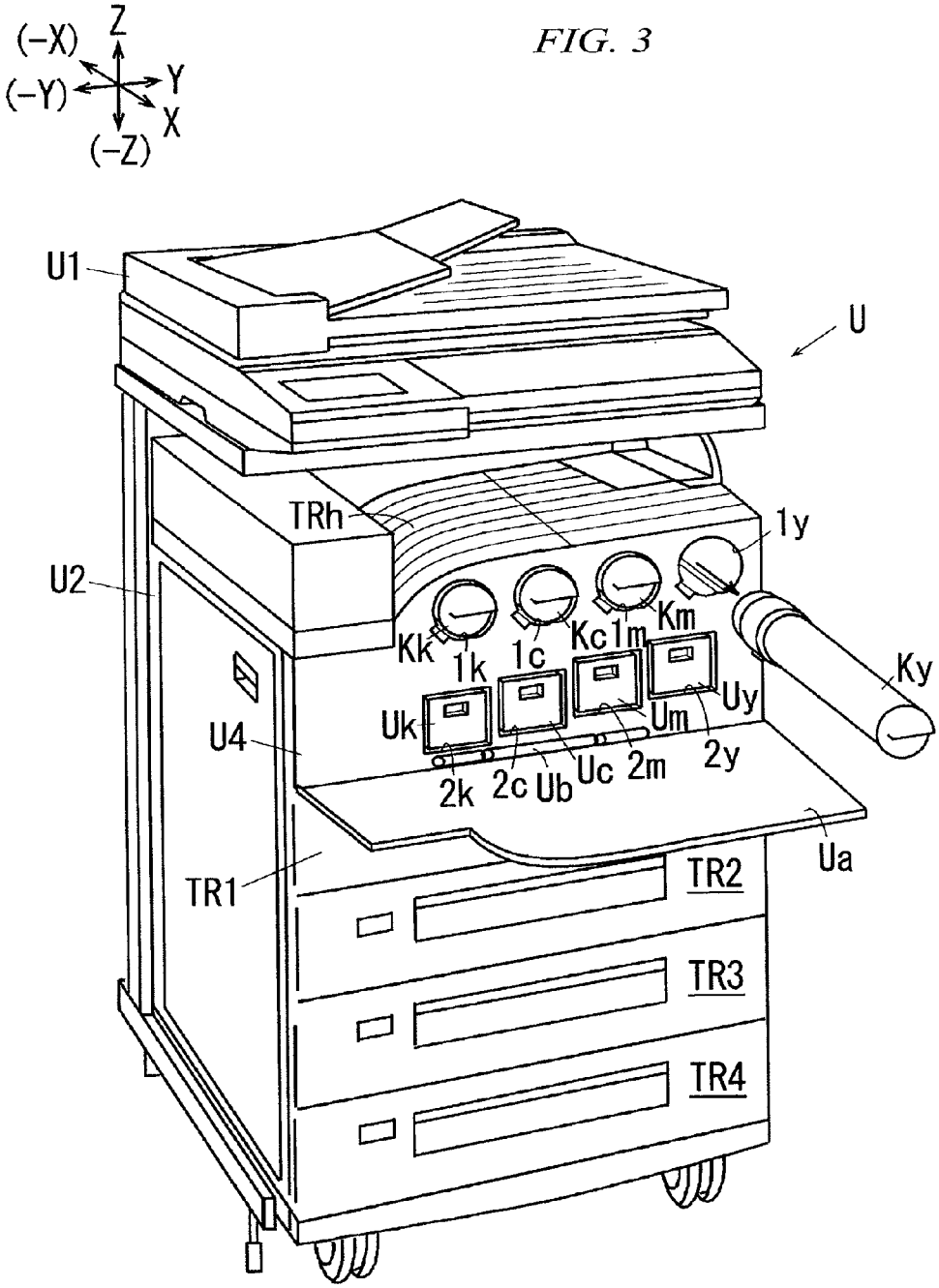
FIG. 3 is an oblique perspective figure of an image-forming apparatus.

Now, reference is made to FIG. 3 that illustrates a situation in which front cover UA of image-forming apparatus U is opened, and developer cartridge Ky of yellow has been pulled out. Front cover Ua of image-forming apparatus U is supported by a hinge so that the front cover can be opened and closed. When an image-forming operation is carried out, or image-forming apparatus U is in a standby mode, front cover Ua is positioned at a normal position (see FIG. 1), and when maintenance work of image-forming apparatus U is carried out, such as replacement of developer cartridge Ky, Km, Kc, or Kk or visible-image-forming device Uy, Um, Uc, or Uk, front cover Ua is positioned at a maintenance work position (see FIG. 3). Inside front cover Ua, front panel U4, which is an example of a front member of apparatus body U1, is provided. In front panel U4, insert holes 1*y*, 1*m*, 1*c*, and 1*k* are provided, through which developer cartridges Ky to Kk are inserted or pulled out. Insert holes 1*y*, 1*m*, 1*c*, and 1*k* are examples of a supply container insert hole. Also, in front panel U4, process cartridge insert holes 2*y*, 2*m*, 2*c*, and 2*k*, through which visible-image-forming devices Uy to Uk are inserted or pulled out, are provided. Process cartridge insert holes 2*y*, 2*m*, 2*c*, and 2*k* are examples of a visible-image-forming device insert hole.

[Configuration of Developer Cartridge]

Since the configurations of developer cartridges Ky to Kk are substantially identical to each other, the following description of the configuration of a developer cartridge will be made taking developer cartridge Ky as an example.

Figure 4:
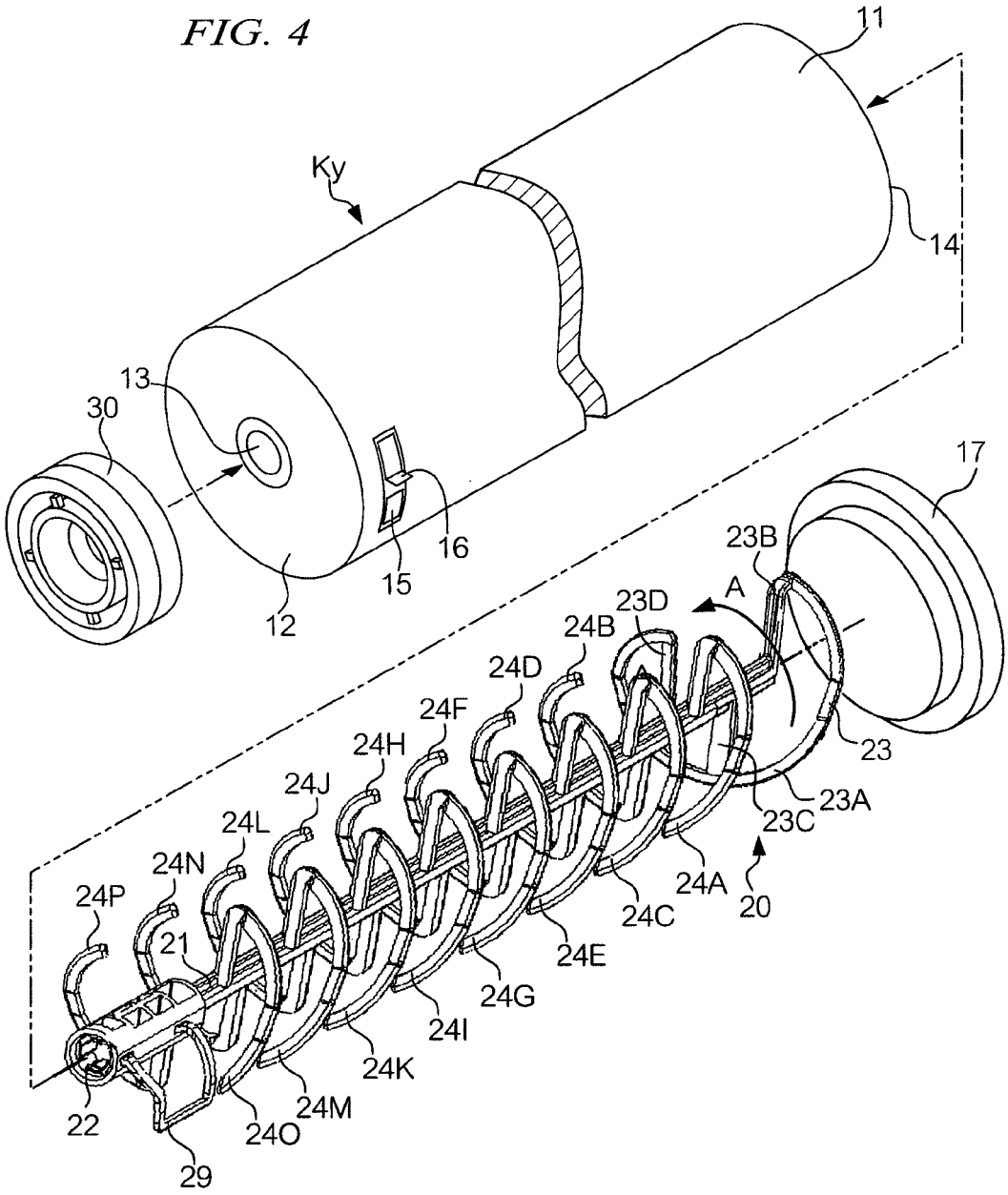
FIG. 4 is an exploded perspective view of a developer cartridge according to an exemplary embodiment of the present invention.

FIG. 4 is an exploded perspective view of developer cartridge Ky. Developer cartridge Ky includes cartridge body 11, cap 17, conveyance member 20, and coupling 30. Cartridge body 11 is a cylindrical member with an end wall, that is fabricated from paper or plastic. Cartridge body 11 stores developers in a cylindrical chamber formed inside the body. Cartridge body 11 has hole 13 at end wall 12, to which a part of coupling 30 is inserted. Also, cartridge body 11 has developer outlet 15 at a part of its outer circumferential surface, the part being near end wall 12, through which developer is supplied to a developing device. Adjacent to developer outlet 15, shutter 16 that covers and exposes developer outlet 15 is provided so that the door can be moved reciprocally in a circumferential direction of cartridge body 11.

Shutter 16 closes developer outlet 15 when the developer cartridge is not attached to image-forming apparatus U, and opens the outlet when the developer cartridge is attached to image-forming apparatus U. If lid 17 is inserted into or engaged with opening 14 of cartridge body 11, opening 14 is covered, and a sealed chamber is provided in developer cartridge Ky.

In cartridge body 11, conveyance member 20, which has a length approximately identical to that of the chamber of cartridge body 11 in the longitudinal direction, is housed. Conveyance member 20 is spirally formed as a single unit, using a thermoplastic resin material such as PP (polypropylene), HDPE (high-density polyethylene), PA (polyamide) (nylon), ABS (acrylonitrile butadiene styrene copolymer), PPE alloy (polyphenylether alloy), or POM (polyoxymethylene). An end of rotational shaft 21 of conveyance member 20 is connected to coupling 30 inserted into hole 13. If coupling 30 is caused to rotate in a direction of arrow A by a driving device (not shown) such as a motor provided in image-forming apparatus U, conveyance member 20, which is connected to coupling 30, is caused to rotate in the direction of arrow A. According to the movement of conveyance member 20, developers stored in cartridge body 11 are conveyed in a direction of conveyance of arrow B (see FIGS. 5 and 6).

[Configuration of Conveyance Member 20]

Figure 5:
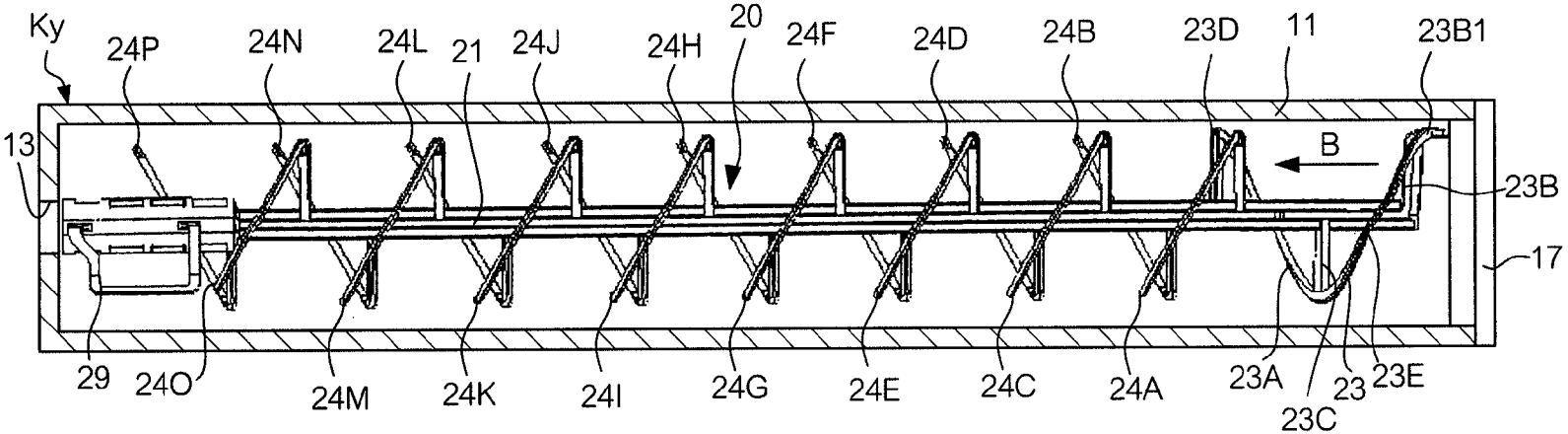
FIG. 5 is a longitudinal sectional view of a developer cartridge.
Figure 6:
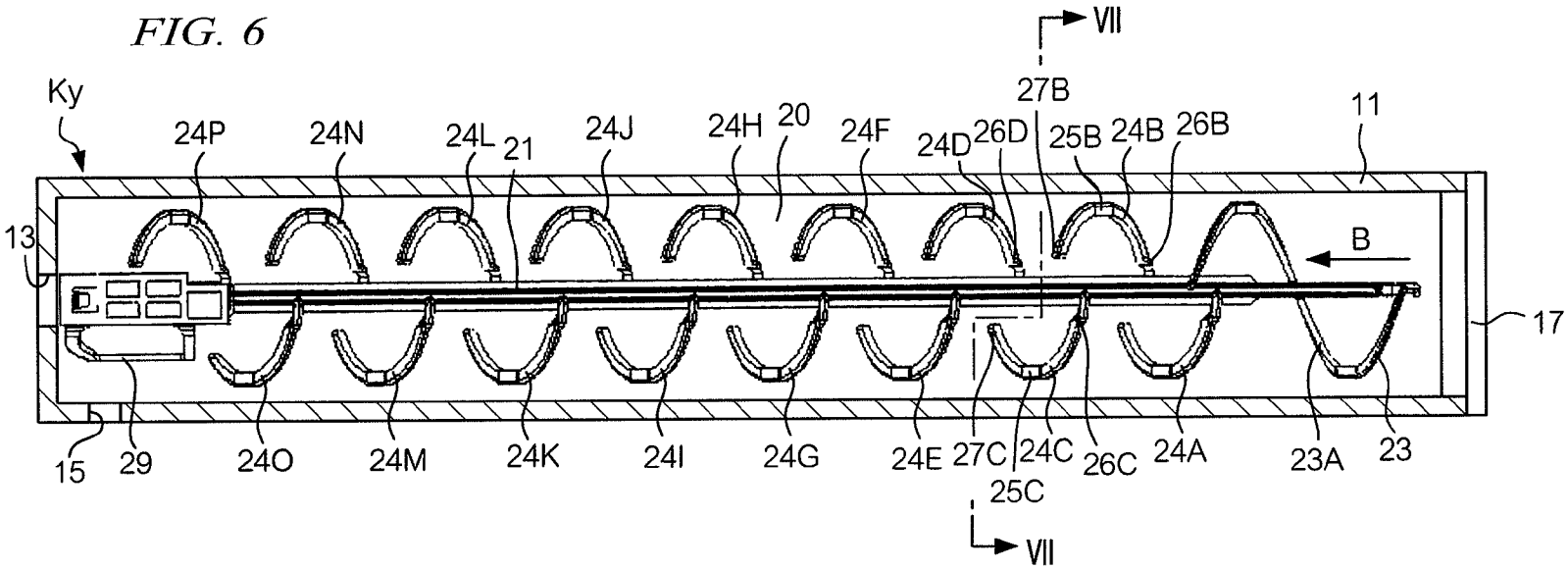
FIG. 6 is a cross-sectional view of a developer cartridge.
Figure 7:
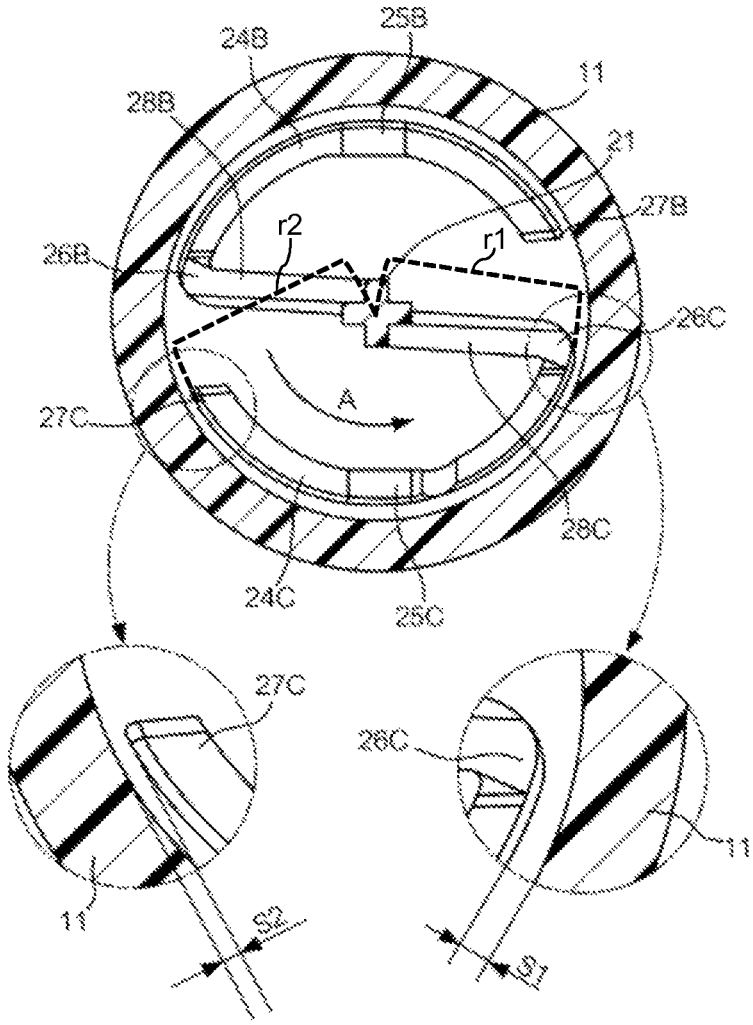
FIG. 7 is a cross-sectional view of a main section of a developer cartridge as viewed in direction VII of FIG. 6.

A configuration of conveyance member 20 will be described in detail with reference to FIGS. 4 to 9. FIG. 5 is a longitudinal sectional view of a developer cartridge. FIG. 6 is a cross-sectional view of a developer cartridge. FIG. 7 is a cross-sectional view of a main section of a developer cartridge as viewed in direction VII of FIG. 6.

Conveyance member 20 includes rotational shaft 21 having a cross-shape or a substantially cross-shape when viewed in cross-section in a longitudinal direction, and conveyance part provided around rotational shaft 21, that conveys developers. The conveyance part includes scraping member 23 provided at one end of rotational shaft 21, 16 arcuate conveyance members 24A to 24P provided along an axial direction of rotational shaft 21, and discharging member 29 provided at the other end of rotational shaft 21. At the other end of rotational shaft 21, attaching unit 22 is provided, to which coupling 30 is attached. Developers are conveyed from an end at which attaching unit 22 is not provided to an end at which attaching unit 22 is provided, along an axial direction of rotational shaft 21. Namely, developers are conveyed in a direction of arrow B.

The end of rotational shaft at which attaching unit 22 is not provided, will hereinafter be referred to as "upstream end," since the end is located in the upstream end in a direction of conveyance of developer. The end of rotational shaft, at which attaching unit 22 is provided, will be hereinafter referred to as "downstream end," since the end is located in the downstream end in a direction of conveyance of developer.

Arcuate conveyance members 24A to 24P are arranged in a zig-zag manner or a substantially zig-zag manner from the upstream end to the downstream end of rotational shaft 21. Scraping member 23 is arranged at a position near the upstream end of rotational shaft 21, and arcuate conveyance members 24A to 24P are arranged in a downstream end, as compared with scraping member 23, of a direction of conveyance of developer. Scraping member 23 and arcuate conveyance members 24A to 24P have slightly different functions. Specifically, scraping member 23 scrapes out developers accumulating in an area near the upstream end of rotational shaft 21, and stirs and conveys the developers in a direction toward the downstream end. On the other hand, arcuate conveyance members 24A to 24P stir and convey developers in a direction toward the downstream end, that are conveyed by a conveyance member located at an upstream end in a direction of conveyance of developer.

In the following description, scraping member 23 and arcuate conveyance members 24A to 24P will be referred to as conveyance member 23 or 24, except where it is necessary to specify otherwise. Also, arcuate conveyance members 24A to 24P will be referred to as arcuate conveyance member 24, except where it is necessary to specify otherwise.

Discharging member 29 is substantially U-shaped, and protrudes from rotational shaft 21. Discharging member 29 stirs developers that have been conveyed from the upstream end to the downstream end in a direction of conveyance, and accumulated near developer outlet 15, and pushes the developers out of developer cartridge Ky through developer outlet 15.

[Configuration of Scraping Member 23]

As shown in FIG. 4, scraping member 23 includes arc portion 23A that has an outer edge forming a spiral arc, and support portions 23B to 23D that support arc portion 23A. Arc portion 23A and support portions 23B to 23D are bar-shaped members having a predetermined thickness. Rotational shaft 21, arc portion 23A, and support portions 23B to 23D have a space between each other. Support portions 23B to 23D include first support portion 23B, intermediate support portion 23C, and second support portion 23D. First support portion 23B is a substantially straight member that is provided at the upstream end of rotational shaft 21, and protrudes in a direction perpendicular to rotational shaft 21. Intermediate support portion 23C is a substantially straight member that is provided at a position downstream compared with first support portion 23B in a direction of conveyance, and protrudes in a direction opposite to the direction in which first support portion 23B protrudes. Second support portion 23D is a substantially straight member that is provided at a position downstream compared with intermediate support portion 23C in a direction of conveyance, and protrudes in a direction opposite to the direction in which intermediate support portion 23C protrudes.

An end of first support portion 23B supports an end of arc portion 23A, and an end of second support portion 23D supports the end of arc portion 23A. An end of intermediate support portion 23C supports a substantially central portion of the arc of arc portion 23A. Since intermediate support portion 23C protrudes in a direction opposite to that in which first support portion 23B protrudes, and second support portion 23D protrudes in a direction opposite to that in which intermediate support portion 23C protrudes, as described above, arc portion 23A has a helical shape having an opening angle of 360 degrees. An opening angle is an angle formed by two lines perpendicular to rotational shaft 21, which extend from the ends of arc portion 23A to rotational shaft 21. Namely, an angle formed by two vertical lines that extend from the ends of arc portion 23A to rotational shaft 21 is 360 degrees.

Arc portion 23A includes linear step portion 23E between a contact with first support portion 23B and a contact point with intermediate support unit 23C, and between a contact point with intermediate support unit 23C and a contact point with second support portion 23D, as shown in FIG. 5. Step portion 23E has a linear shape because conveyance member 20, after being cast, can be easily removed from a mold; accordingly, if the problem of casting is cleared, step portion 23E may have a curved shape (the same is true of arc portion 25, which is described later). First support portion 23B includes protruding portion 23B1 that protrudes from the upstream end of rotational shaft 21 in an upstream direction (to the right in FIG. 5). The tip of protruding portion 23B1 supports an end of arc portion 23A.

[Configuration of Discharging Member 29]

As shown in FIG. 6, discharging member 29 is provided so that when conveyance member 20 is housed in cartridge body 11, the member faces developer outlet 15. Also, discharging member 29 is provided so that as viewed in a direction perpendicular to rotational shaft 21, at least a part of discharging member 29 overlaps arcuate conveyance member 29P, which is disposed at the furthermost downstream end of rotational shaft 21 in a direction of conveyance.

[Configuration of Arcuate Conveyance Member 24]

A configuration of arcuate conveyance member 24 will be described with reference to FIG. 7, taking arcuate conveyance members 24B and 24C, which are disposed at an upstream end in a direction of conveyance, as examples. It is to be noted that in FIG. 7, an alphabet included in each symbol has the same meaning as that included in the element names "arcuate conveyance members 24A to 24P." Namely, an element shown in FIG. 7 is a component of arcuate conveyance member 24 to which an alphabet is attached.

Arcuate conveyance member 24B includes arc portion 25B that includes fixed end 26B located at a front side in a rotational direction and free end 27B located at a back side in the rotational direction, and support portion 28B that extends from rotational shaft 21 in a radial direction of a cross-section of cartridge body 11, and supports arc portion 25B at fixed end 26B so that arc portion 25B is arranged in a direction not perpendicular to an axial direction to rotational shaft 21. Similarly, arcuate conveyance member 24C includes arc portion 25C that includes fixed end 26B located at a front side in a rotational direction and free end 27C located at a back side in the rotational direction, and support portion 28C that extends from rotational shaft 21 in a radial direction of a cross-section of cartridge body 11, and supports arc portion 25C at fixed end 26C so that arc portion 25C is arranged in a direction not perpendicular to an axial direction of rotational shaft 21. An angle formed by two lines perpendicular to rotational shaft 21, which extend from the ends of arc portion 25B or 25C (namely, an opening angle of arc portion 25B or 25C) is, for example, 155 degrees. Rotational shaft 21, arc portions 25B and 25C, and support portions 28B and 28C are bar-shaped members, and they have a space between each other.

Arcuate conveyance members 24, which are adjacent to each other, are arranged so that as viewed in a direction perpendicular to rotational shaft 21, parts of the adjacent members overlap each other, as shown in FIGS. 5 and 6. If this arrangement is explained by taking arcuate conveyance members 24B, 24C, and 24B as an example, a support portion of arcuate conveyance member 24C that supports a fixed end of the conveyance member is disposed at an upstream end in a direction of conveyance as compared with a free end of arcuate conveyance member 24B, which is disposed at an upstream side relative to arcuate conveyance member 24C, and adjacent to arcuate conveyance member 24C. Also, a free end of arcuate conveyance member 24C is disposed at a downstream end in a direction of conveyance as compared with a support portion of arcuate conveyance member 24D that supports a fixed end of the conveyance member, which is disposed at a downstream end relative to arcuate conveyance member 24C, and adjacent to arcuate conveyance member 24C. This arrangement in which parts of adjacent arcuate conveyance members 24 overlap each other is employed for all other adjacent arcuate conveyance members 24 as well. Further, scraping member 23 and arcuate conveyance member 24A, which is adjacent to scraping member 23, are disposed so that parts of the members overlap each other, and discharging member 29 and arcuate conveyance member 24P, which is adjacent to discharging member 29, are disposed so that parts of the members overlap each other, as well.

Arc portion 25C is formed so that its outer diameter becomes larger from a position of fixed end 26C toward a position of free end 27C, as viewed in an axial direction of rotational shaft 21. To realize this, arc portion 25C may be formed so that it gradually deviates outward from a position of fixed end 26C toward a position of free end 27C. Alternatively, arc portion 25C may be formed so that its thickness becomes larger from a position of fixed end 26C toward a position of free end 27C.

For example, if it is assumed that a distance between the center of rotational shaft 21 and the external edge of fixed end 26C is r1, and a distance between the center of rotational shaft 21 and the external edge of free end 27C is r2, r1 is smaller than r2. Also, if it is assumed that a distance between the external edge of fixed end 26C and an inner surface of cartridge body 11 is S1, and a distance between the external edge of free end 27C and an inner surface of cartridge body 11 is S2, as shown in FIG. 7, S1 is larger than S2. To give a concrete example, if it is assumed that the inner diameter of cartridge body 11 is 51 mm, a case may be considered in which r1 is 24.5 mm, r2 is 25.0 mm, S1 is 1.0 mm, and S2 is 0.5 mm. Arcuate conveyance members 24 other than arcuate conveyance member 24C have arc portion 25 that has a shape similar to that of arc portion 25C of arcuate conveyance member 24C. If single arcuate conveyance member 24 is noted, fixed end 26 is located in an upstream side in a direction of conveyance of developer, and free end 27 is located at a downstream end in the direction of conveyance of developer; namely, the outer diameter of arc portion 25 is smaller in an upstream end in the direction of conveyance, and larger in a downstream end in the direction of conveyance. Accordingly, a distance between the external edge of arc portion 25 and an inner surface of cartridge body 11 is larger at an upstream end in the direction of conveyance, and smaller at a downstream end in the direction of conveyance.

If a distance between the external edge of conveyance member 20 and an inner surface of cartridge body 11 is small, an amount of developer that slips through a space between the external edge of conveyance member 20 and an inner surface of cartridge body 11, when developer is conveyed, is reduced. Accordingly, to improve efficiency of conveying developer, it is required that the distance between the external edge of conveyance member 20 and an inner surface of cartridge body 11 be shortened. However, improved efficiency of conveying developer leads to developer being subjected to larger forces from conveyance member 20. For example, if developer is continually subjected to such a force between the external edge of conveyance member 20 and an inner surface of cartridge body 11, the developer is more likely to form aggregation.

In a case of conveyance member 20, since distance S1 of the side of fixed end 26 is larger than distance S2 of the side of free end 27, as described above, developer is not likely to be continually subject to large forces between the external edge of fixed edge 26 and an inner surface of cartridge body 11, when conveyance member 20 is caused to rotate. Accordingly, clumping of developer is prevented. Also, since distance S2 of the side of free end 27 is smaller than distance S1 of the side of fixed end 26, efficiency of conveying developer is improved.

Figure 8B:
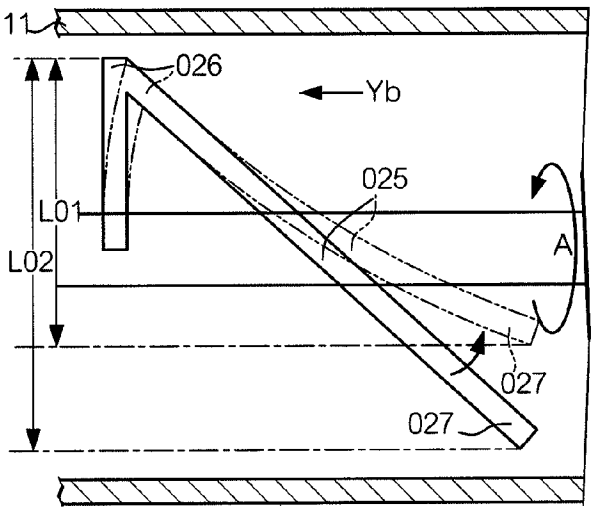
FIGS. 8A and 8B are explanatory diagrams showing deformation of an arcuate conveyance member and conveyance performance of the same member.
Figure 8A:
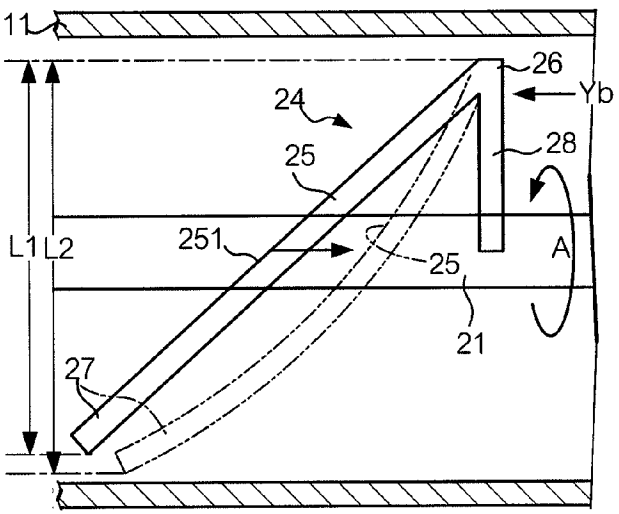

Another mechanism of conveyance member 20 (arcuate conveyance member 24) will be described with reference to FIGS. 8A and 8B. FIGS. 8A and 8B are diagrams showing deformation of arcuate conveyance member 24 that occurs when developers are conveyed.

In developer cartridge Ky, if conveyance member 20 (arcuate conveyance member 24) is caused to rotate in a direction of arrow A, arc portion 25 is subject to a force, which is a reaction to a force by which arc portion 25 pushes developer backward, and thereby arc portion 25 is deformed.

In conveyance member 20 according to the present exemplary embodiment, since arc portion 25 is cantilevered, if the portion is subjected to a reaction force, free end 27 of the portion is deformed so that the force is diverted. Accordingly, in the present exemplary embodiment, even in a case where a plastic material is used that has a strength lower than that of a metal, a conveyance resistance and a torque do not become excessive, conveyance member 20 is resistant to damage, and the cost of raw materials and high-volume manufacturing is reduced.

Also, in conveyance member 20 which is capable of easily warding off forces, and whose conveyance resistance is reduced, arc portion 25 is not so plastically deformed when loaded, and if the burden of developers is removed, arc portion 25 is likely to elastically restore to its original form. Namely, conveyance member 20 according to the present exemplary embodiment has an improved restoration as compared with a conventional conveyance member, the resistance being responsive to deformation that is caused by a force applied when developers are conveyed. Accordingly, in conveyance member 20 according to the present exemplary embodiment, an amount of plastic deformation with time of conveyance member 20 is reduced, and therefore an amount of change in conveyance performance of conveyance member 20 is reduced.

FIGS. 8A and 8B are explanatory diagrams showing deformation of a conveyance member and conveyance performance of the same member. FIG. 8A is an explanatory diagram showing deformation of a conveyance member that extends toward a downstream side, as in the case of the exemplary embodiment described above, and conveyance performance of the same member. FIG. 8B is an explanatory diagram showing deformation of a conveyance member that extends toward an upstream side, and conveyance performance of the same member.

In conveyance member 20 according to the present exemplary embodiment, arc portion 25, which is spirally arranged and arc-shaped, extends toward a downstream side in direction of conveyance B, as shown in FIGS. 6, 7, and 8A. If it is assumed that arc portion 025 extends toward an upstream side in direction of conveyance B, as shown in FIG. 8B, a part of arc portion 025 provided at the side of free end 027 is bent in a direction toward a base end, as shown by the dashed line of FIG. 8B, by a force applied to arc portion 025 from developers that are stirred and conveyed. In this case, if it is assumed that a pre-deformation length from fixed end 026 to free end 027 of arc portion 025, which is projected to a plane perpendicular to an axial direction, is length L01, and a post-deformation length from fixed end 026 to free end 027 of arc portion 025, which is similarly projected to a plane perpendicular to an axial direction, is length L02, length L01 is shorter than length L02. Lengths L01 and L02 correspond to an effective area of arc portion 025 by which developers are conveyed in a direction toward a downstream side, and in the configuration shown in FIG. 8B, it is possible that a performance of conveying developers is lowered due to deformation of arc portion 025.

On the other hand, in the configuration shown in FIG. 8A, if arc portion 25 is subject to a force and deformed during stirring and conveying of developers, post-deformation length L2 is longer than pre-deformation length L1. Namely, an amount of decrease in a conveyance performance is reduced. Also, front surface 251 of arc portion 25 is inclined relative to direction of conveyance Yb before the arc portion is deformed; however, while the arc portion is deformed, the arc portion has a form such that front surface 251 is close to perpendicular to direction of conveyance Yb. Namely, a performance of pushing and conveying developers is improved.

Also, arcuate conveyance member 24 is formed so that the center angle of the arc of arc portion 25 is approximately 155 degrees, and the center angle does not exceed 360 degrees. Accordingly, an amount of deformation of free end 27 of arc portion 25 is relatively small, and arc portion 25 is not likely to come into contact with an inner surface of cartridge body 11. Accordingly, as compared with a case in which a center angle is larger, and an amount of deformation is larger, noise and increase in torque, which results from contacts of free end 27 with an inner surface of cartridge body 11, is reduced.

Also, conveyance member 20 has a configuration whereby developer is likely to accumulate in a downstream side in a direction of conveyance; accordingly, a load applied to arc portion 25 becomes smaller toward an upstream side in a direction of conveyance. In conveyance member 20, scraping member 23 is arranged at the upstream end of the conveyance member, in which an applied load is smaller, and a possibility of fracturing is lower. Accordingly, in conveyance member 20, it is possible to provide scraping member 23 with arc portion 23A, the center angle of the arc of which is 360 degrees. Also, the spiral structure of arc portion 23A supported by plural support portions 23B to 23D is prevented from expanding when arc portion 23A is deformed.

[Modifications]

The above exemplary embodiment may be modified as described below.

(1) In the above exemplary embodiment, where in all arcuate conveyance members 24A to 24P the outer diameter of an arc portion at a position of fixed end 26 is smaller than that at a position of free end 27, all arcuate conveyance members do not have to have such a configuration. It may be that at least one of an arcuate conveyance member has such a configuration. Also, it is to be noted that the number of scraping members 23 or arcuate conveyance members 24 may be determined at need.

Figure 9:
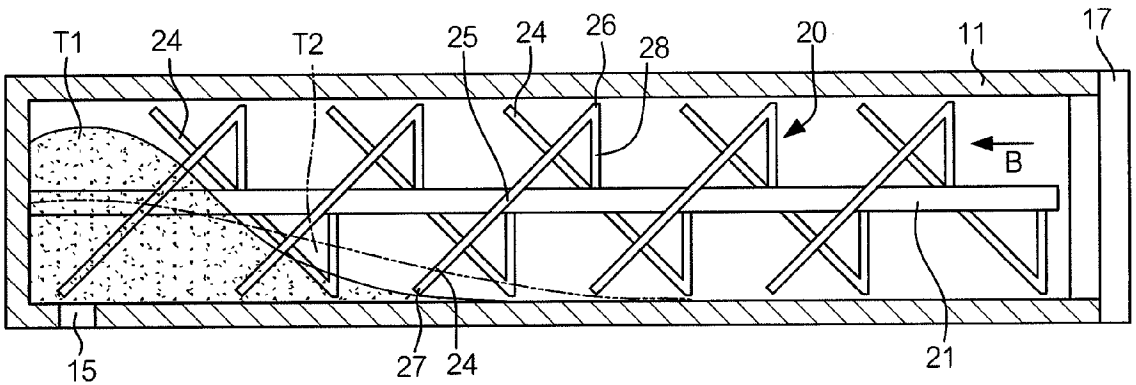
FIG. 9 is a diagram showing developer conveyed according to modification (2)

(2) In conveyance member 20 according to the above exemplary embodiment, arcuate conveyance members 24 all having an identical shape are disposed in an axial direction of rotational shaft 21. By rotation of conveyance member 20, developer stored in cartridge body 11 is conveyed from the upstream end to the downstream end, as described above. The conveyed developer forms heap T1 having its peak around developer outlet 15, as shown in FIG. 9. However, since developer is atomized, heap T1 is likely to collapse to form gentle slope T2, which is indicated by a two-dot chain line in FIG. 9. In the state of slope T2, an amount of developer discharged through developer outlet 15 is reduced, and therefore supply of developer may be disrupted.

Figure 10:
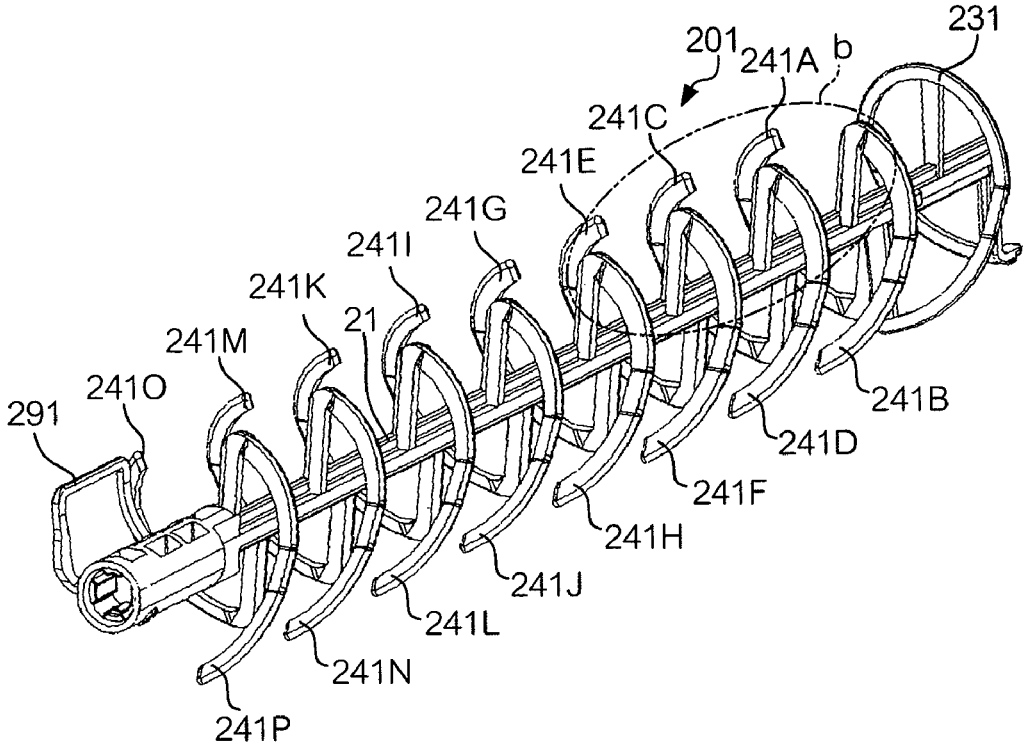
FIG. 10 is an oblique perspective figure of a conveyance member according to modification (2)

In view of the above problem, it is considered that conveyance member 201 having a configuration shown in FIG. 10 is employed. Conveyance member 201 has a configuration substantially similar to that of conveyance member 20 described in the above exemplary embodiment. Specifically, conveyance member 201 includes scraping/conveyance member 231 provided at one end of rotational shaft 21, discharging/conveyance member 291 provided at the other end of rotational shaft 21, and arcuate conveyance members 241A to 241P provided between scraping/conveyance member 231 and discharging/conveyance member 291. Also, conveyance member 201 is formed so that among arcuate conveyance members 241A to 241P, arc portions 25 of arcuate conveyance members 241A to 241H (see area b), which are disposed at an upstream end in a direction of conveyance, have a width greater than that of arc portions of the other arcuate conveyance members, and arc portions of arcuate conveyance members 2411 to 241P, which are disposed at a downstream end in a direction of conveyance, have a width smaller than that of arc portions of the other arcuate conveyance members. The width is a width of arc portion 25, for example, as viewed in an axial direction of rotational shaft 21. In conveyance member 201 having such a configuration, conveyance capability of arc portions 25 provided at an upstream end is higher than that of arc portions 25 provided at a downstream end; accordingly, conveyed developer is likely to retain the shape of heap T1.

Figure 11:
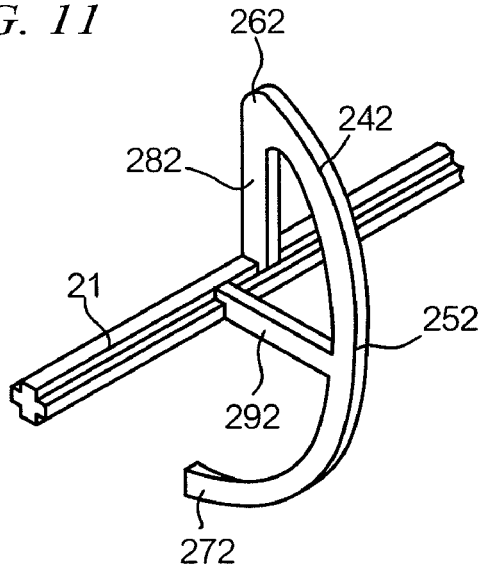
FIG. 11 is an oblique perspective figure of an arcuate conveyance member according to modification (3).

(3) In the above exemplary embodiment, where arc portion 25 is formed to be a cantilever (specifically, fixed end 26 of arc portion 25 is supported by support portion 28 that extends from rotational shaft 21 in a radial direction), arcuate conveyance member 24 may be formed as shown in FIG. 11. Arcuate conveyance member 242 shown in FIG. 11 includes arc portion 252 that includes fixed end 262 and free end 272, the free end being located at a back end in a rotational direction, support portion 282 that supports fixed end 262 so that arc portion 252 is disposed in a direction not perpendicular to an axial direction of rotational shaft 21, and reinforcing portion 292 that reinforces arc portion 252, the reinforcing portion being disposed in a position that is tilted around rotational shaft 21 at 90 degrees relative to support portion 282.

In arcuate conveyance member 242 having such a configuration, movement of arc portion 252 in a radial direction is prevented by reinforcing portion 292.

(4) In the above exemplary embodiment, a size of a space formed by rotational shaft 21, an arc portion, and a support portion of a conveyance member 23 or 24 may be determined at need. If the space is made smaller by use of a thick arc portion or support portion, conveyance capability is improved, but a reaction force received from developer is increased. Accordingly, it is necessary to expect a larger amount of deformation of conveyance members 23 and 24. On the other hand, if the space is made larger by use of a thin arc portion or support portion, conveyance capability is lowered, but a reaction force received from developer is decreased. Accordingly, an amount of deformation of conveyance members 23 and 24 is reduced.

(5) In the above exemplary embodiment, an opening angle of arc portion 25 of arcuate conveyance member 24 does not have to be 155 degrees. However, since arcuate conveyance member 24 needs to be flexible in a direction toward rotational shaft 21 in response to a reaction force from developer, the central angle of arc portion 25 relative to rotational shaft 21 has to be smaller than or equal to 360 degrees.

(6) In the above exemplary embodiment, conveyance member 20 may be made of a material other than a plastic, as long as the material has adequate flexibility. Also, conveyance member 20 may be formed by combining of a rotational shaft, an arc portion, and a support unit, which are separately manufactured, instead of being formed as a single unit.

(7) In the above exemplary embodiment, where an opening angle of arc portion 23A of scraping/conveyance member 23 is 360 degrees, the opening angle may be smaller than 360 degrees, as in the case of an arcuate conveyance member. However, since scraping/conveyance member 23 is disposed at the furthermost upstream end of rotational shaft 21 in a direction of conveyance, the member is required to have adequate scraping capability. Accordingly, it is preferable that scraping/conveyance member 23 has an arc portion whose slope relative to a rotational shaft is larger than that of arc portions of the other arcuate conveyance members 24, and whose outer edge is located away from rotational shaft 21 as compared with that of arc portions of the other arcuate conveyance members 24.

(8) In the above exemplary embodiment, where developer cartridge Ky is constituted by cartridge body 11 and lid 17 that covers opening 14 of cartridge body 11, end wall 12 of cartridge body 11 may be configured as a lid detachable from the body, as in the case of lid 17.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A conveyance member comprising:

a rotational shaft;

a support portion that extends from the rotational shaft in a direction crossing an axial direction of the rotational shaft; and an arcuate member that includes one end that is supported by the support portion, and another end that extends in a direction different from the rotational direction, wherein a distance between an outer edge of the arcuate member at the other end and the rotational shaft is longer than a distance between an outer edge of the arcuate member at the one end and the rotational shaft.

2. The conveyance member according to claim 1, wherein a thickness of the arcuate member at the one end is larger than a thickness of the arcuate member at the other end.

3. The conveyance member according to claim 1, further comprising:

another support portion that extends from the rotational shaft in a direction crossing an axial direction of the rotational shaft; and another arcuate member that includes one end that is supported by the other support portion, and another end that extends in a direction different from the rotational direction, wherein:

the other arcuate member is adjacent to the arcuate member in the axial direction of the rotational shaft; and a part of the arcuate member and a part of the other arcuate member overlap each other, as viewed in a direction perpendicular to the axial direction of the rotational shaft.

4. The conveyance member according to claim 2, further comprising:

another support portion that extends from the rotational shaft in a direction crossing an axial direction of the rotational shaft; and another arcuate member that includes one end that is supported by the other support portion, and another end that extends in a direction different from the rotational direction, wherein:

the other arcuate member is adjacent to the arcuate member in the axial direction of the rotational shaft; and a part of the arcuate member and a part of the other arcuate member overlap each other, as viewed in a direction perpendicular to the axial direction of the rotational shaft.

5. The conveyance member according to claim 1, wherein the rotational shaft has a substantially cross-shape when viewed in cross-section in a longitudinal direction.

6. The conveyance member according to claim 1, further comprising:

another support portion that extends from the rotational shaft in a direction crossing an axial direction of the rotational shaft; and another arcuate member that includes one end that is supported by the other support portion, and another end that extends in a direction different from the rotational direction, wherein the arcuate member and the other arcuate member are arranged in a substantially zig-zag manner, as viewed in a direction perpendicular to the axial direction of the rotational shaft.

7. The conveyance member according to claim 1, further comprising a scraping member provided at the rotational shaft.

8. The conveyance member according to claim 1, further comprising a substantially U-shaped discharging member provided at the rotational shaft.

9. A developer cartridge comprising:

a cartridge body including:

a chamber that contains developers; and an outlet that discharges the developers from the chamber, and a conveyance member that is caused to rotate in the cartridge body, the conveyance member comprising:

a rotational shaft;

a support portion that extends from the rotational shaft in a direction crossing an axial direction of the rotational shaft; and an arcuate member that includes one end that is supported by the support portion, and another end that extends in a direction different from the rotational direction, wherein a distance between an outer edge of the arcuate member at the other end and the rotational shaft is longer than a distance between an outer edge of the arcuate member at the one end and the rotational shaft.

10. The developer cartridge according to claim 9, wherein a thickness of the arcuate member of the conveyance member at the one end is larger than a thickness of the arcuate member of the conveyance member at the other end.

11. The developer cartridge according to claim 9, wherein the rotational shaft of the conveyance member has a substantially cross-shape when viewed in cross-section in a longitudinal direction.

12. The developer cartridge according to claim 9, wherein:

the conveyance member further comprises:

another support portion that extends from the rotational shaft in a direction crossing an axial direction of the rotational shaft; and another arcuate member that includes one end that is supported by the other support portion, and another end that extends in a direction different from the rotational direction, and the arcuate member and the other arcuate member are arranged in a substantially zig-zag manner, as viewed in a direction perpendicular to the axial direction of the rotational shaft.

13. The developer cartridge according to claim 9, wherein the conveyance member further comprises a scraping member provided at the rotational shaft.

14. The developer cartridge according to claim 9, wherein the conveyance member further comprises a substantially U-shaped discharging member provided at the rotational shaft.

15. An image-forming apparatus comprising:

an image carrier that carries an image;

a latent-image-forming unit that forms a latent image on the image carrier;

a developing unit that develops the latent image;

a transfer unit that transfers an image developed by the developing unit to a recording medium;

a fixing unit that fixes an image transferred by the transfer unit on a recording medium; and a developer cartridge including:

a cartridge body having:

a chamber that stores developers to be used by the developing unit; and an outlet that discharges the developers from the chamber, and a conveyance member that is caused to rotate in the cartridge body, the conveyance member comprising:

a rotational shaft;

a support portion that extends from the rotational shaft to a direction crossing an axial direction of the rotational shaft; and an arcuate member that includes one end that is supported by the support portion, and another end that extends in a direction different from the rotational direction, wherein a distance between an outer edge of the arcuate member at the other end and the rotational shaft is longer than a distance between an outer edge of the arcuate member at the one end and the rotational shaft.

16. The image-forming apparatus according to claim 15, wherein a thickness of the arcuate member of the conveyance member at the one end is larger than a thickness of the arcuate member of the conveyance member at the other end.

17. The image-forming apparatus according to claim 15, wherein the rotational shaft of the conveyance member has a substantially cross-shape when viewed in cross-section in a longitudinal direction.

18. The image-forming apparatus according to claim 15, wherein:

the conveyance member further comprises:

another support portion that extends from the rotational shaft in a direction crossing an axial direction of the rotational shaft; and another arcuate member that includes one end that is supported by the other support portion, and another end that extends in a direction different from the rotational direction, and the arcuate member and the other arcuate member are arranged in a substantially zig-zag manner, as viewed in a direction perpendicular to the axial direction of the rotational shaft.

19. The image-forming apparatus according to claim 15, wherein the conveyance member further comprises a scraping member provided at the rotational shaft.

20. The image-forming apparatus according to claim 15, wherein the conveyance member further comprises a substantially U-shaped discharging member provided at the rotational shaft.

* * * * *